United States Patent [19]

Schuster

[11] Patent Number: 4,802,071

[45] Date of Patent: Jan. 31, 1989

[54] LANTERN CANDY CARRIER

[76] Inventor: Herbert J. Schuster, 41 Lakeshore Dr., Apt. 802, Toronto, Ontario, Canada, M8V 1Z3

[21] Appl. No.: 123,418

[22] Filed: Nov. 20, 1987

[51] Int. Cl.[4] ..... F21V 33/00

[52] U.S. Cl. ..... 362/154; 446/485; 362/808

[58] Field of Search ..... 362/157, 806, 808, 154, 362/156; 446/485

[56] References Cited

U.S. PATENT DOCUMENTS

| | | | |
|---|---|---|---|
| 699,669 | 5/1902 | Duket | 362/806 |
| 741,293 | 10/1903 | Barnes | 362/806 |
| 2,631,224 | 3/1953 | Root | 362/190 |
| 2,685,022 | 7/1954 | Root et al. | 362/191 |
| 3,340,133 | 9/1967 | Krekovich | 362/808 |
| 4,652,980 | 3/1987 | Segar | 362/806 |
| 4,698,732 | 10/1987 | Hickey | 362/154 |

*Primary Examiner*—Ira S. Lazarus
*Assistant Examiner*—Peggy Neils
*Attorney, Agent, or Firm*—Kenneth M. Garrett

[57] ABSTRACT

This invention is a battery-powered lantern which is used by a child to collect Halloween treats. The outer shell simulates a jack-o'-lantern. It improves the child's ability to see and/or be seen at night. Other uses include: use as an illuminated ornament or use as a novelty toy.

6 Claims, 3 Drawing Sheets

LANTERN CANDY CARRIER

FIELD OF INVENTION

This invention relates to battery-powered lanterns which are used to carry candy, etc., such as Halloween treats.

BACKGROUND OF INVENTION

One present practice is to carry a flashlight in one hand and a shopping bag in the other hand. Also, there are numerous unlit devices for carrying Halloween treats.

BRIEF SUMMARY OF INVENTION

Incorporating a battery-powered light source into a relatively large shell produces a lantern which is also used to carry candy and Halloween treats in one hand leaving the other hand free. The shell is shaped and coloured to suit a festive occasion such as Halloween. One embodiment of the invention simulates a jack-o'-lantern and is used by a child to collect Halloween treats. A safety feature is that the lantern is easily visible and enables the child to both see and been seen better.

DESCRIPTION OF THE PREFERRED EMBODIMENT

Figure 1:
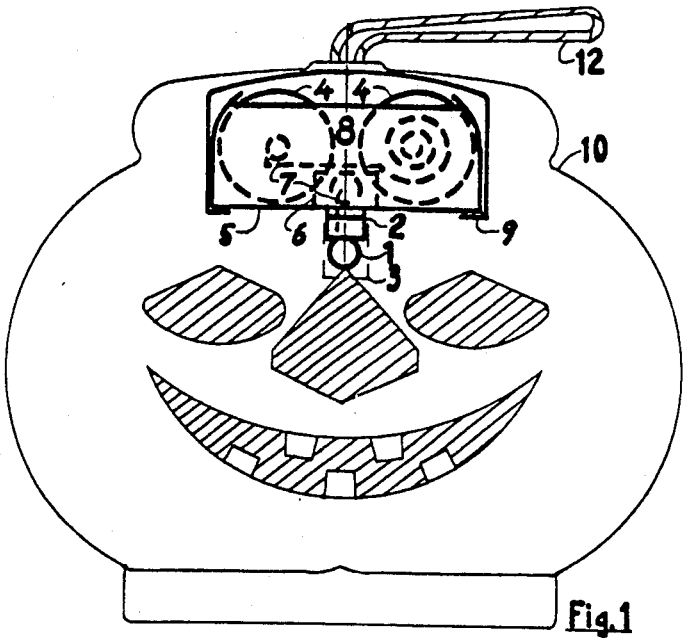
FIG. 1 is an elevation of one embodiment of the invention with a ghost view of the outer shell 10.
Figure 2:
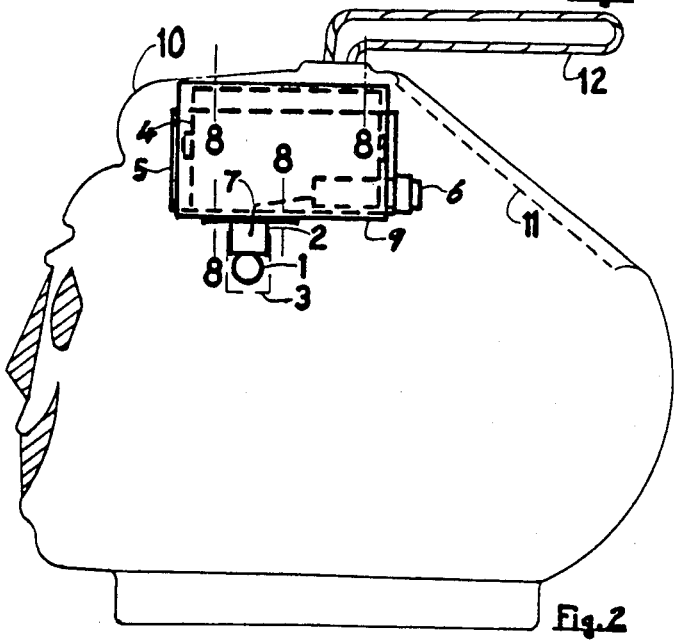
FIG. 2 is a side view of the same embodiment of the invention with a ghost view of the outer shell 10.
Figure 3:
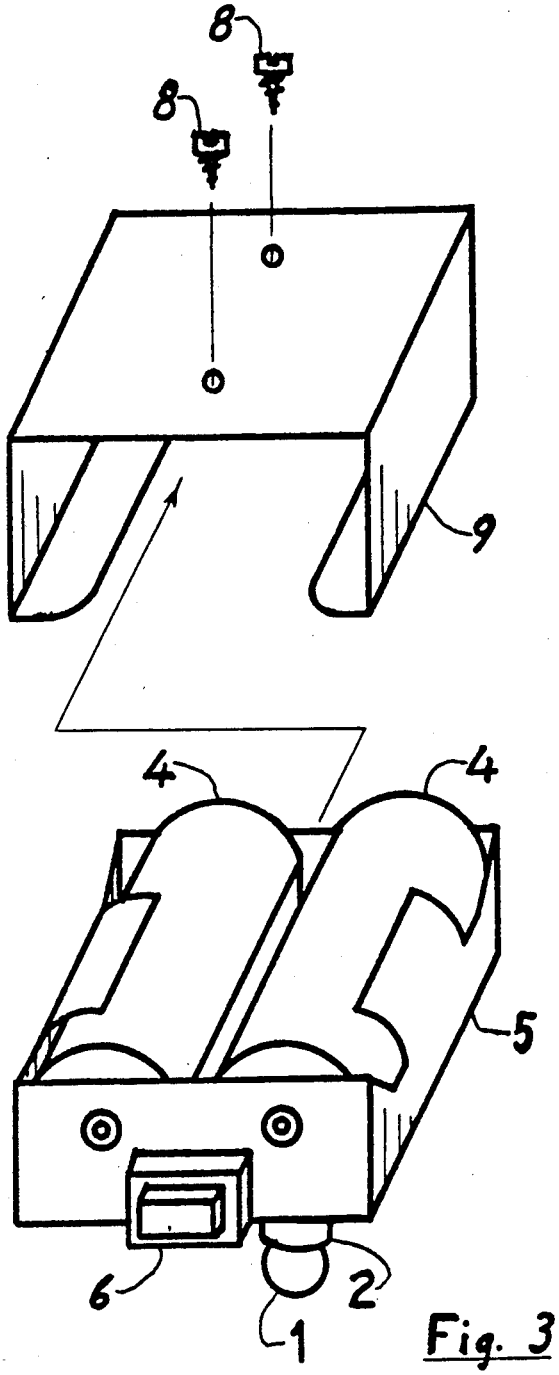
FIG. 3 is an oblique projection of the light source subassembly showing how it slides into (or out of) the clip 9.
Figure 4:
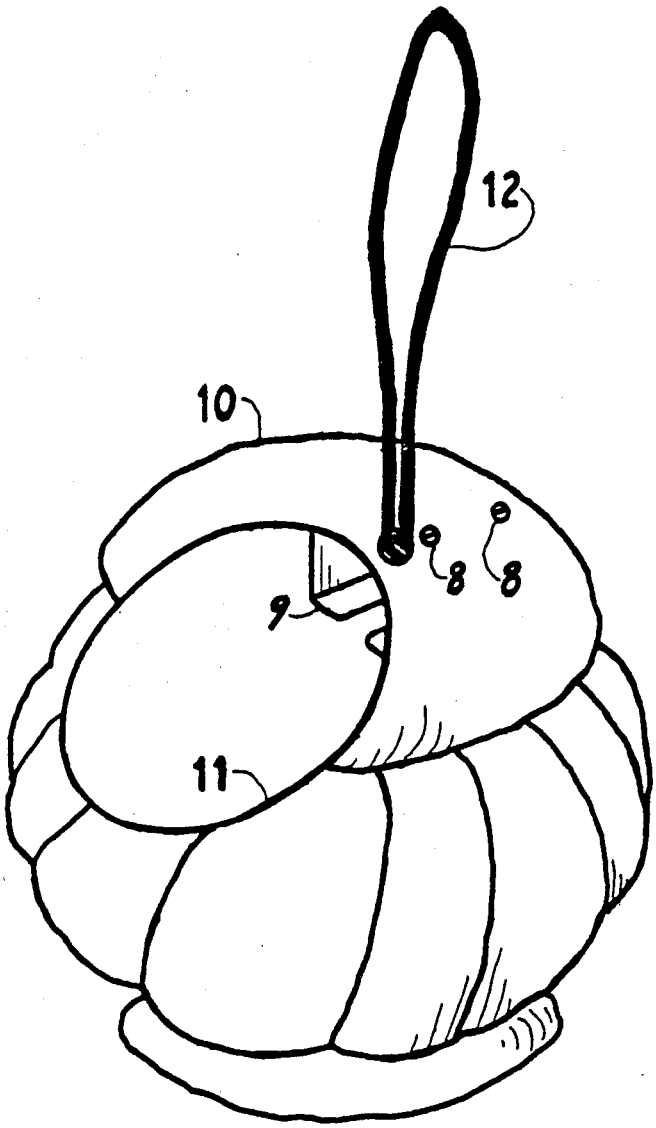
FIG. 4 is a view from the upper right rear showing how the clip 9 is mounted inside at the top of the outer shell 10, allowing access through the opening 11.

The lantern illustrated is separable into two subassemblies:

(a) The light source subassembly comprising a lamp 1 and lamp holder 2, (with guard 3), and batteries 4 in battery holder 5, with switch 6 and electric conductors 7 arranged as desired to complete the electric circuit. Fasteners 8, such as pop rivets or self-tapping screws are used in this embodiment of the invention, although other means of assembly could be used instead.

(b) The shell subassembly comprising the clip 9, which is attached to the outer shell 10 by fasteners 8. Note the opening 11 through which candy and Halloween treats are placed inside the outer shell 10. The opening 11 also provides access to the switch 6 and for removal of the light source subassembly for maintenance such as replacing the light bulb 1 or batteries 4.

In the illustrated embodiment of the invention a flexible plastic strap with "T" shape steps moulded onto each end is doubled up and pulled through as small opening in the top of the shell 10 to form the handle 12.

Shell 10 is generally in the shape of a pumpkin i.e. it is somewhat spheroid in shape. As such it may be considered to have a polar axis which, when the lantern is carried by handle 12, will be oriented in the vertical direction. Opening 11 locates in a plane downwardly rearwardly inclined to the polar axis, and is centered rearwardly thereof, so as to afford some protection from the elements for the treats to be carried in the shell 10 and also for the lighting subassembly. The positioning of the opening in this manner further serves to limit the volume of treats that may be carried in shell 10. Generally speaking, it is desirable that the lower level of the periphery of the opening be no higher than the level of lamp 1, whereby lamp 1 will always illuminate at least upper portions of the shell, which may be suitably formed of a translucent material configured as a jack-o'-lantern. Additionally, rays from lamp 1 may also escape from shell 10 directly through opening 11, for greater levels of illumination.

I claim:

1. A lantern for carrying Halloween treats or the like comprising:

a hollow, pumpkin like shell having a polar axis and including a side wall and top wall bridging said side wall;

a portion of said side wall being configured with a design thereon defining a forward face of said shell; at least said configured portion being translucent;

said shell having an opening therein to provide hand access within said shell for insertion and removal of treats;

handle means secured to said shell for carrying said lantern with the polar axis generally vertically oriented;

said opening located in at least one plane inclined to the polar axis and extending partly in portions of said side wall opposed to said forward face and partly in said top wall; and illumination means mounted within said shell and located to illuminate said configured portion and simultaneously to be viewable along generally horizontal lines of sight through said access opening; said illumination means comprises an electric lamp supported from said top wall of said shell adjacent said opening to provide hand access.

2. A lantern as defined in claim 1, wherein said illumination means comprises a battery carrier including terminals and circuit means operatively connecting said terminals to said electric lamp.

3. A lantern as defined in claim 2, wherein said circuit means includes switch means locating proximate said access opening for selectively connecting and disconnecting said lamp and at least one said terminals in electrical relationship.

4. A lantern as defined in claim 3, wherein said switch and electric lamp are mounted from said battery carrier, and further comprising means for detachably mounting said battery carrier from said shell.

5. A lantern as defined in claim 4, wherein said battery carrier mounting means is secured to said shell adjacent said access opening.

6. A lantern as defined in claim 1, wherein said configured portions have the appearance of a jack-o'-lantern.

* * * * *